United States Patent [19]

Piber

[11] Patent Number: 4,568,807

[45] Date of Patent: Feb. 4, 1986

[54] TRIGGER TOOL HANDLE SWITCH WITH STRUCTURAL DUST SEAL

[75] Inventor: Earl T. Piber, Oconomowoc, Wis.

[73] Assignee: Eaton Corporation, Cleveland, Ohio

[21] Appl. No.: 637,172

[22] Filed: Aug. 2, 1984

[51] Int. Cl.[4] ..... H01H 13/06

[52] U.S. Cl. ..... 200/302.2; 200/304; 200/157

[58] Field of Search ..... 200/304, 302.2, 340, 200/157

[56] References Cited

U.S. PATENT DOCUMENTS

| | | | |
|---|---|---|---|
| 1,907,688 | 5/1933 | Von Henke | 200/302.2 |
| 2,430,064 | 11/1947 | Lawson | 200/302.2 |
| 3,093,715 | 6/1963 | Kaneko | 200/67 |
| 3,360,627 | 12/1967 | Wessel | 200/302.2 |
| 3,775,576 | 11/1973 | Brown | 200/157 |
| 3,778,577 | 12/1973 | Fromknecht et al. | 200/168 G |
| 4,241,297 | 12/1980 | Piber et al. | 318/17 |

FOREIGN PATENT DOCUMENTS

| | | | |
|---|---|---|---|
| 2478772 | 9/1981 | France | 200/302.2 |
| 2046996 | 11/1980 | United Kingdom | 200/340 |
| 543026 | 3/1977 | U.S.S.R. | 200/302.2 |

*Primary Examiner*—Stephen Marcus
*Assistant Examiner*—Renee S. Kidorf
*Attorney, Agent, or Firm*—C. H. Grace; L. G. Vande Zande

[57] ABSTRACT

A molded insulating switch housing (2) has a rectangular opening (2*a*) in an end wall thereof through which an actuator (4) having a rectangular cross-sectional shape extends for linear reciprocable movement and is biased to an extended position with respect to the housing. A trigger operator member (6) is affixed to the outer end of the actuator (4) and has a recess (6*b*) open toward the end wall of the housing (2). A continuous rectangular flange (2*b*) surrounds the opening (2*a*) in the end wall and is telescopically received within the recess (6*b*) of the trigger operator (6) to form a dust and foreign contaminant material seal for the switch. Lateral edges (2*d*) of the switch housing at the end wall containing the opening for the actuator extend beyond the end wall and are provided with openings (2*e*) that have one edge coextensive with the end wall for removing dust and other contaminant materials which may be slid against the housing end wall by movement of the trigger (6) along the outer surfaces of the flange (2*b*).

12 Claims, 6 Drawing Figures

TRIGGER TOOL HANDLE SWITCH WITH STRUCTURAL DUST SEAL

BACKGROUND OF THE INVENTION

This invention relates to electric switches and more particularly relates to such switches which are utilized to control a hand-held portable electric tool such as a drill, saw or the like. Switches of this type are normally mounted in the handle of the tool and have a trigger portion extending through the handle for depression by the forefinger of the hand gripping the tool. The switch may be of the ON-OFF type or may be of a speed control type wherein the speed of the tool motor is controlled by the amount of depression of the trigger.

The nature of the application of switches of the aforementioned type places them in an environment continuously contaminated by dust and small particles of the object being worked on by the tool. The trigger comprises a switch actuator member which is linearly depressible through an opening in the switch housing. This action in a contaminated environment promotes the entry of dust and foreign particles into the switch housing and the switch contact area. Moreover, the actuator member is commonly formed in a rectangular or straight-sided configuration to maintain proper orientation of the actuator to the switching structure within the switch housing. Conventional sealing means for linearly depressible members are predominantly designed for use with such members that have round or cylindrical shapes. The rectangular shape of trigger tool handle switch actuators renders them particularly difficult to seal against the entry of dust and other foreign contaminant materials.

SUMMARY OF THE INVENTION

This invention provides an electric switch of the type suitable for use as a trigger tool handle switch for a portable electric tool wherein a switch actuator is linearly reciprocably movable inwardly and outwardly of the switch housing and has a rectangular shape cooperating with a complementally formed opening in an end wall of the switch housing and with the interior of the switch housing to maintain proper orientation of the actuator with respect to the switch contact structure. The switch housing and actuator have a cooperating structural configuration for sealing against the entrance of dust or other foreign contaminant particles into the switch housing, the cooperating structural configuration comprising a continuous flange on the housing surrounding the opening and projecting in the direction of actuator movement and a recess in a trigger element formed on the projecting end of the actuator, the recess defining a skirt portion which surrounds the flange in a light sliding-friction telescoping relationship. This switch, its features and advantages, will be more fully understood when reading the following description and claims in conjunction with the accompanying drawings.

DESCRIPTION OF THE PREFERRED EMBODIMENT

Figure 1:
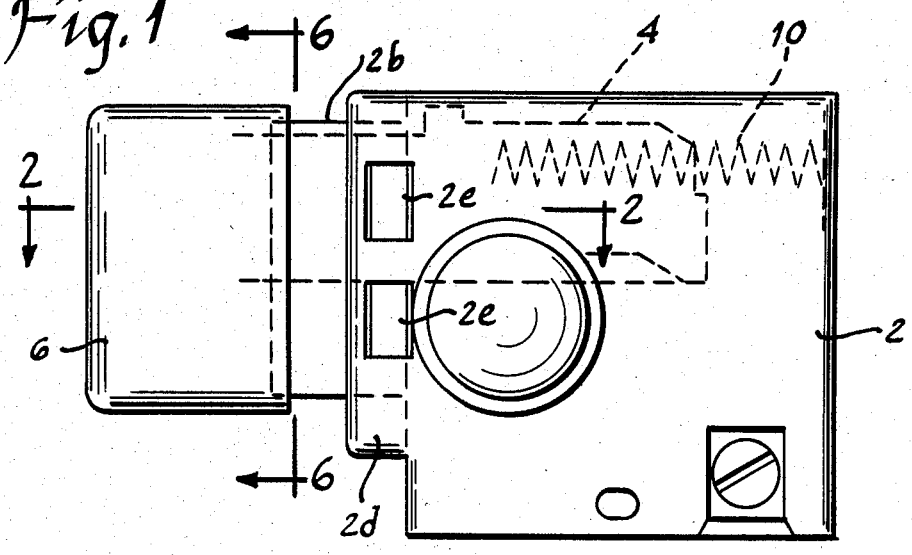
FIG. 1 is a side elevational view of a switch constructed in accordance with this invention.
Figure 2:
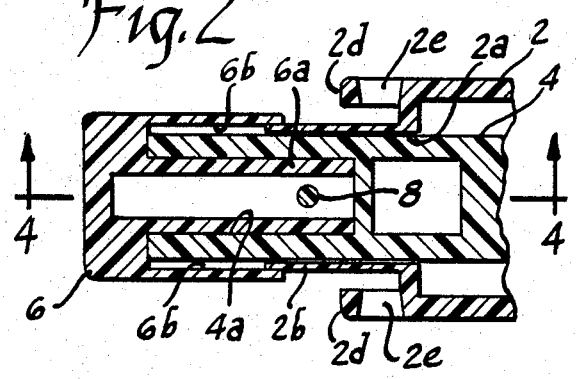
FIG. 2 is a horizontal cross-sectional view taken along the line 2—2 in FIG. 1 showing the trigger operator and actuator member in an extended position with respect to the switch housing.
Figure 3:
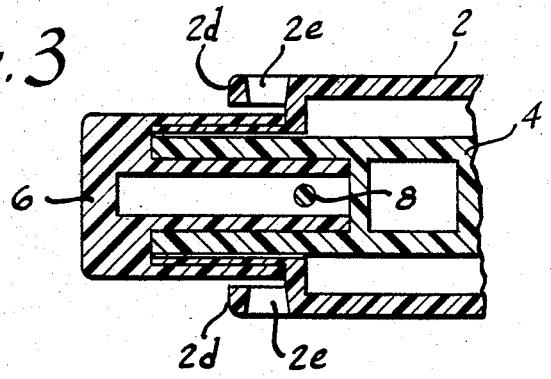
FIG. 3 is a horizontal cross-sectional view similar to FIG. 2, but showing the trigger operator and actuator in a depressed position with respect to the switch housing.

A switch embodying the invention is shown in FIG. 1 of the drawings. The switch comprises a molded insulating housing 2 having a switch actuator 4 mounted therein for linear reciprocable movement left and right as viewed in the drawing. The actuator 4 extends through an opening **2*a* in the left-hand end wall of housing 2 and has a trigger operator 6 on the projecting outer end thereof. Although it is not essential to the invention, it is preferred that the trigger operator 6 and actuator 4 be formed of separate members and joined together as a subassembly. To this end, the actuator 4 has a rectangular recess 4*a* as seen best in FIG. 6 open to its outermost end, and trigger 6 has a hollow rectangular boss 6*a* projecting to the right as viewed in the drawings. Trigger 6 is assembled to actuator 4 by inserting boss 6*a* into opening 4*a* and securing the trigger to the actuator with a pin 8 which extends through aligned holes in actuator 4 and boss 6*a* as seen best in FIG. 4. Trigger 6 is essentially a hollow member having a recess 6*b* open to the end thereof adjacent housing 2 whereby the peripheral walls of the trigger 6 which define the recess 6*b* form a skirt which projects toward the left-hand end wall of housing 2**.

Figure 4:
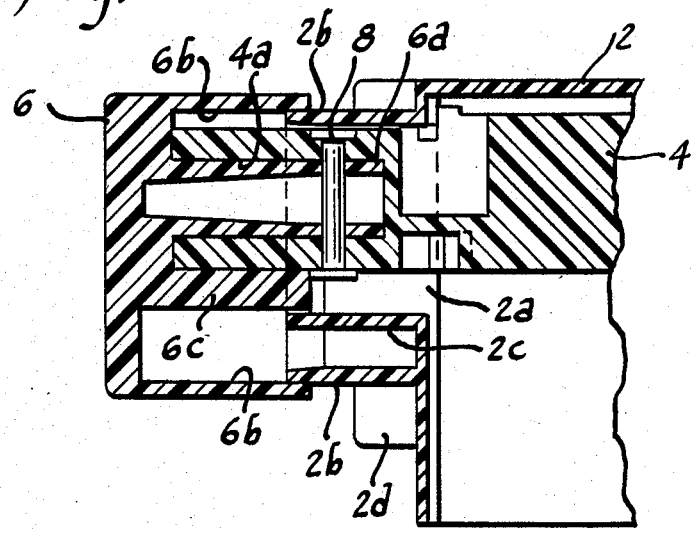
FIG. 4 is a vertical cross-sectional view of the switch of this invention taken along the line 4—4 in FIG. 2.
Figure 5:
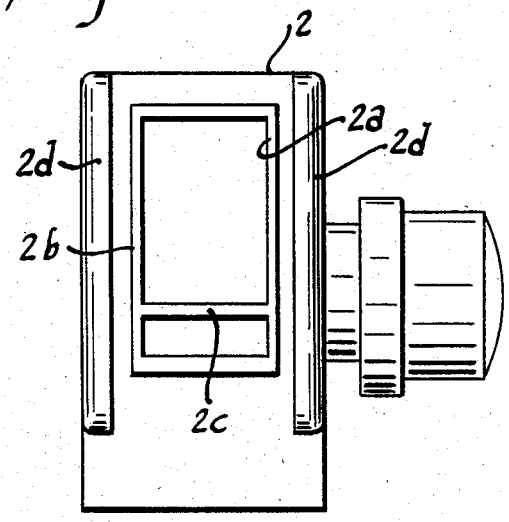
FIG. 5 is a view of the left-hand end of the switch housing shown in FIG. 1 with the trigger operator and actuator member removed therefrom.
Figure 6:
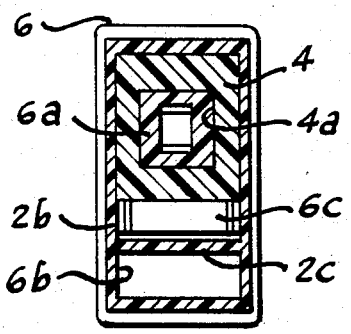
FIG. 6 is a lateral cross-sectional view taken along the line 6—6 in FIG. 1.

The lateral or transverse cross-sectional configuration of actuator 4 is rectangular as may be best seen in FIG. 6. Similarly, the opening **2*a* in housing 2 is also rectangular as is best seen in FIG. 5. A rectangular continuous flange 2*b* is formed on the left-hand end wall of housing 2 to surround the opening 2*a*. The vertical dimension of flange 2*b* corresponds to the vertical dimension of the internal recess 6*b* in trigger operator 6. The vertical dimension of the opening 2*a* is somewhat less than the vertical dimension of the flange 2*b* and an intermediate flange wall 2*c* is provided adjacent the lower edge of opening 2*a* to provide additional guiding for the actuator. As seen in FIGS. 4 and 6, the vertical dimension of actuator 4 within the opening 2*a* is somewhat less than the corresponding dimension of the opening 2*a*, and trigger 6 is provided with a boss portion 6*c* which extends within the flanged opening 2*a* immediately above the flange 2*c* whereby the combined lateral crosssectional shape of actuator 4 and trigger 6 correspond to the rectangular dimensions of the opening 2*a*. The recess 6*b* and the external dimensions of flange 2*b* are dimensioned with close tolerances so as to provide a sliding, light frictional fit between these elements. Accordingly, as actuator 4 and trigger operator 6 are depressed to move the actuator inwardly of the housing 2 against the bias of a return spring 10, particles of dust or other foreign contaminants will be pushed along the surface of flange 2*b* and will not be permitted to enter the housing 2 or the recess 6*b*** of the trigger.

The end wall of housing 2 containing opening **2*a* has a pair of ribs 2*d* formed along the opposite lateral edges thereof projecting toward trigger 6 and extending beyond the flange 2b at the top and bottom edges thereof. The ribs 2d provide the switch housing 2 with a side profile required for switches which are to be sold to the European market. The ribs 2d overlap the skirt portion of trigger 6 and thereby form pockets in which dust and contaminant particles carried along flange 2b by the skirt portion of trigger 6 may become impacted. A build-up of material in these pockets will prevent full depression of the trigger and actuator. To avoid this problem, each rib 2d is provided with openings 2e, the right-hand end wall of the respective openings 2d being coextensive with the left-hand end wall of the housing 2. As the trigger and actuator assembly are moved to the depressed position, the openings 2e provide egress ports for the dust and other foreign contaminant particles that may be slid along the flange 2b** toward the end wall.

It will be apparent from the foregoing that this invention provides an improved trigger tool handle switch which utilizes structural features of the housing and trigger actuator to seal against entry of dust and contaminant material into the switch housing. Although the trigger tool handle switch with structural sealing configuration of this invention has been described in a single preferred embodiment, it is to be understood that it is susceptible of various modifications without departing from the scope of the appended claims.

I claim:

1. In a self-contained trigger tool handle switch comprising a housing, a linearly movable actuator within said housing biased to an extended position wherein a portion of said actuator projects through an opening in an end wall of said housing, said actuator being movable inwardly of said housing for effecting actuation of said switch, and said projecting portion having a trigger operator rigidly affixed thereon, the improvement comprising:

a continuous flange surrounding said opening in said housing end wall and extending along said projecting portion of said actuator, and said trigger having a recess open toward said housing end wall defining a skirt which surrounds said flange in telescoping relationship therewith.

2. The invention defined in claim 1 wherein said flange and said recess in said trigger are rectangular.

3. The invention defined in claim 1 wherein said skirt is arranged to provide light frictional engagement with said flange.

4. The invention defined in claim 1 wherein said housing has a pair of ribs disposed along opposite lateral edges of said end wall, said ribs extending in the direction of said flange and overlapping said skirt when said actuator is moved inwardly for effecting switch actuation.

5. The invention defined in claim 4 wherein said ribs have laterally directed openings therethrough for permitting egress of foreign objects as said skirt moves toward said end wall.

6. The invention defined in claim 5 wherein one wall defining respective ones of said laterally directed openings is coextensive with said end wall of said housing.

7. A self-contained electric switch adapted for mounting in the handle of a portable electric powered tool comprising, in combination:

a molded insulating switch housing having an opening in an end wall and an integral outwardly projecting continuous flange surrounding said opening;

a switch actuator mounted in said housing for linear reciprocal movement along an axis extending through said opening and having an end portion projecting through said opening beyond said flange; and a trigger operator member rigidly affixed on said projecting end portion of said actuator for projecting through a clearance opening in said tool handle, said trigger having a skirt portion extending toward said housing end wall along said flange in telescoping relationship therewith.

8. The invention defined in claim 7 wherein said flange and said skirt have a rectangular configuration in a plane transverse to said axis.

9. The invention defined in claim 7 wherein said skirt has a frictional sliding engagement with said flange.

10. The invention defined in claim 7 wherein said housing has ribs formed at opposite lateral edges of said end wall, said ribs extending along said flange in laterally spaced relation thereto for defining a particular side profile for said housing, and said skirt moves between said flange and said ribs when said trigger is moved inwardly toward said housing end wall.

11. The invention defined in claim 10 wherein said ribs are provided with laterally directed openings therethrough for permitting egress of foreign objects as said skirt moves toward said end wall.

12. The invention defined in claim 11 wherein said end wall forms one wall of said openings.

* * * * *